US007604782B1

(12) United States Patent
Dingell et al.

(10) Patent No.: US 7,604,782 B1
(45) Date of Patent: Oct. 20, 2009

(54) HEAT REJECTION SUBLIMATOR

(75) Inventors: Charles W. Dingell, Friendswood, TX (US); Clemente E. Quintana, Houston, TX (US); Suy Le, League City, TX (US); Michael R. Clark, LaPorte, TX (US); Robert E. Cloutier, Webster, TX (US); David Scott Hafermalz, Houston, TX (US)

(73) Assignee: The United States of America as represented by the National Aeronautics and Space Administration, Washington, DC (US)

( * ) Notice: Subject to any disclaimer, the term of this patent is extended or adjusted under 35 U.S.C. 154(b) by 446 days.

(21) Appl. No.: 11/625,670

(22) Filed: Jan. 22, 2007

(51) Int. Cl.
*B01D 5/00* (2006.01)

(52) U.S. Cl. ..... 422/244; 23/294 R

(58) Field of Classification Search ..... 422/244; 23/294 R

See application file for complete search history.

(56) References Cited

U.S. PATENT DOCUMENTS

| | | | |
|---|---|---|---|
| 3,079,765 | A | 3/1963 | Vantine |
| 3,152,774 | A | 10/1964 | Wyatt |
| 3,170,303 | A | 2/1965 | Rannenberg et al. |
| 3,197,973 | A | 8/1965 | Rannenberg et al. |
| 3,212,286 | A | 10/1965 | Curtis |
| 3,463,150 | A | 8/1969 | Penfold |
| 3,490,718 | A | 1/1970 | Vary |
| 3,613,775 | A | 10/1971 | Curtis et al. |
| 3,635,216 | A | 1/1972 | Curtis |
| 4,007,601 | A | 2/1977 | Webbon |
| 5,246,061 | A | 9/1993 | Zalite |
| 5,946,931 | A | 9/1999 | Lomax et al. |

OTHER PUBLICATIONS

Curtis et al., An Advanced Submilator for Active Space Heat Rejection, AIAA Paper No. 73-1337, Dec. 1973, pp. 1-10.
Dingell et al., Updated Environmental Control System for the X-38 Crew Return Vehicle, SAE Technical Paper Series, 1999-01-1935, Jul. 1999, pp. 1-13.
Leimkuhler et al., Development of a Cotnaminant Insensitive Sublimator, 2006 SAE International, 2006-01-2217, Jul. 2006.

*Primary Examiner*—Edward M Johnson
(74) *Attorney, Agent, or Firm*—Theodore U. Ro

(57) ABSTRACT

A sublimator includes a sublimation plate having a thermal element disposed adjacent to a feed water channel and a control point disposed between at least a portion of the thermal element and a large pore substrate. The control point includes a sintered metal material. A method of dissipating heat using a sublimator includes a sublimation plate having a thermal element and a control point. The thermal element is disposed adjacent to a feed water channel and the control point is disposed between at least a portion of the thermal element and a large pore substrate. The method includes controlling a flow rate of feed water to the large pore substrate at the control point and supplying heated coolant to the thermal element. Sublimation occurs in the large pore substrate and the controlling of the flow rate of feed water is independent of time. A sublimator includes a sublimation plate having a thermal element disposed adjacent to a feed water channel and a control point disposed between at least a portion of the thermal element and a large pore substrate. The control point restricts a flow rate of feed water from the feed water channel to the large pore substrate independent of time.

19 Claims, 4 Drawing Sheets

HEAT REJECTION SUBLIMATOR

BACKGROUND OF INVENTION

1. Field of the Invention

The invention relates generally to sublimators used for heat rejection.

2. Background Art

During manned space missions, it is important to control the environment for the well being of the human participants. Paramount among environmental concerns is the dissipation of heat that may accumulate from the combined metabolic heat given off by the passengers and waste heat from electronics. One strategy that has been used to dissipate heat is evaporative cooling or evaporative heat rejection. Several designs have been developed that use sublimators as a means of dissipating unwanted heat for vehicular and space suit cooling.

A sublimator is an evaporative heat rejection device that provides cooling by evaporative venting of water vapor into space, transferring the latent energy in the water vapor away from the vehicle. Water has a latent heat of vaporization of 2461 kJ/kg, which makes evaporative cooling an effective process for dissipating unwanted heat. These devices take advantage of the vacuum of space and the phase properties of water below its triple point temperature to remove water vapor directly from the solid phase (ice) by a process called sublimation. This is possible because below the triple point pressure of water (4.56 mmHg), water exists either in solid phase (ice) or gas phase (water vapor) depending on the temperature.

Typically, the sublimation process in a sublimator device begins by delivery of feed water to a porous substrate surface with one face exposed to a vacuum. The low pressure causes the water vapor to freeze within the pores of the substrate. Eventually, a layer of ice forms filling the substrate pores. Delivery of heat, via a heated coolant, to the porous substrate causes sublimation of the ice. Water vapor is vented into space with the net effect of the dissipation of heat. The cycle starts anew as more feed water replenishes the ice layer in the porous substrate. Most importantly, the process is self regulating because the water flow rates are controlled by the ice layer. Although this example shows the use of water as the evaporant (sublimant), other evaporants may be used such as R134a. However, a layer of ice would not form if a refrigerant was used and the evaporant flow rate may require additional controls.

Sublimators known in the art control the evaporant flow rate by use of a single porous substrate with a precise range of pore sizes. Pores that are too large cause the rapid loss of evaporant. Typical porous materials may have pore sizes ranging in size from 3-6 μm. When the water sublimes from the porous substrate, non-volatile contaminants are often left behind in the small pores. Over time, the performance of the sublimator may be compromised by the accumulation of these non-volatile contaminants and the porous substrate requires replacement or removal and cleaning, both of which may be costly.

One solution to the accumulation of non-volatile contaminants is to separate the evaporant flow control element and the site of sublimation. If the sublimation portion of the device can be constructed such that it has very large pores, then it may be insensitive to the accumulation of non-volatile materials. Such a strategy has been disclosed, for example, by Curtis U.S. Pat. No. 3,613,775 in which a Teflon® (Teflon® is a registered trademark of DuPont, Wilmington, Del.) felt material is used to distribute feed water on to a metal surface covered with an open-cell foam with large pore sizes. It has been observed by those skilled in the art, however, that the Teflon® felt layer compresses over time, which results in a loss of efficiency in feed water distribution.

SUMMARY OF INVENTION

In one aspect, embodiments of the present invention relate to a sublimator comprising: a sublimation plate comprising: a thermal element disposed adjacent to a feed water channel; and a control point disposed between at least a portion of the thermal element and a large pore substrate; wherein the control point comprises a sintered metal material.

In one aspect, embodiments of the present invention relate to a method of dissipating heat using a sublimator comprising: a sublimation plate comprising: a thermal element; wherein the thermal element is disposed adjacent to a feed water channel; and a control point disposed between at least a portion of the thermal element and a large pore substrate; the method comprising: controlling a flow rate of feed water to the large pore substrate at the control point; and supplying heated coolant to the thermal element, wherein sublimation occurs in the large pore substrate; and wherein the controlling of the flow rate of feed water is independent of time.

In one aspect, embodiments of the present invention relate to a sublimator comprising: a sublimation plate comprising: a thermal element disposed adjacent to a feed water channel; and a control point disposed between at least a portion of the thermal element and a large pore substrate, wherein the control point restricts a flow rate of feed water from the feed water channel to the large pore substrate independent of time.

Other aspects and advantages of the invention will be apparent from the following description and the appended claims.

DETAILED DESCRIPTION

One or more embodiments of the present invention provide sublimators with enduring performance that can withstand the collection of non-volatile contaminants in the region of sublimation and also maintain their structural integrity. In one aspect, embodiments of the present invention relate to the structural elements of a sublimator. In one aspect, embodiments of the present invention relate to a method of using a sublimator for heat rejection.

Figure 1:
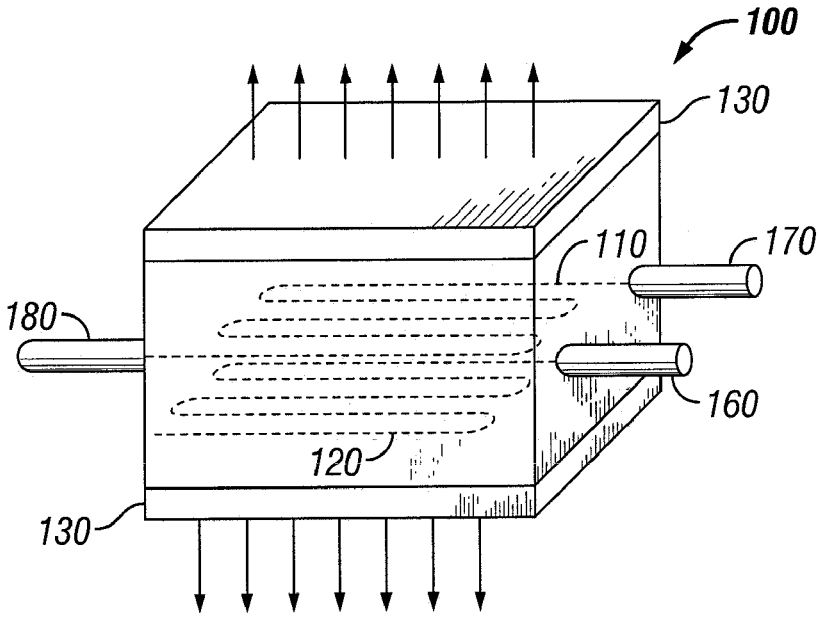
FIG. 1 shows a sublimation plate in accordance with one or more embodiments of the present invention.

Referring to FIG. 1, in one or more embodiments, a sublimation plate 100 comprises a thermal element 110 for carrying a heated coolant, a feed water channel 120, and a large pore substrate 130, from which ice may sublime (in the direction of the arrows). Feed water channel 120 is connected to a control point (not shown) which is responsible for distributing feed water from feed water channel 120 to the large pore substrate 130. The presence of a vacuum freezes the feed water in large pore substrate 130. Subsequently, the ice may sublime aided by the transfer of heat from the heated coolant in thermal element 110 to large pore substrate 130. In the embodiment shown, two large pore substrates are included, one on each side of the feed water channel 120 and thermal element 110, such that sublimation can occur from both sides. Those skilled in the art will appreciate that, in one or more embodiments, there may be only one large pore surface from which sublimation occurs.

In one or more embodiments, a sublimation plate 100 may be equipped with inlets 160 and 170 for the delivery of feed water and heated coolant to feed water channel 120 and thermal element 110, respectively. Additionally, sublimation plate 100, may be equipped with an outlet 180 for the coolant to be recycled from the system. Although functionally operable as a single plate, in one or more embodiments, any number of sublimation plates 100 may be incorporated in a sublimator, for example, as shown in FIGS. 2 and 3.

The number of sublimation plates 100 used in a sublimator may be affected by a variety of factors such as the amount of heat requiring dissipation and the total weight of the sublimator apparatus. The latter factor may be a substantial consideration when the sublimator is used for space missions, because the weight of every on-board component should be minimized. Thus, the choice of the number of sublimation plates 100, may be a balance between the weight of each added sublimation plate 100 and the amount of heat requiring dissipation.

Figure 2:
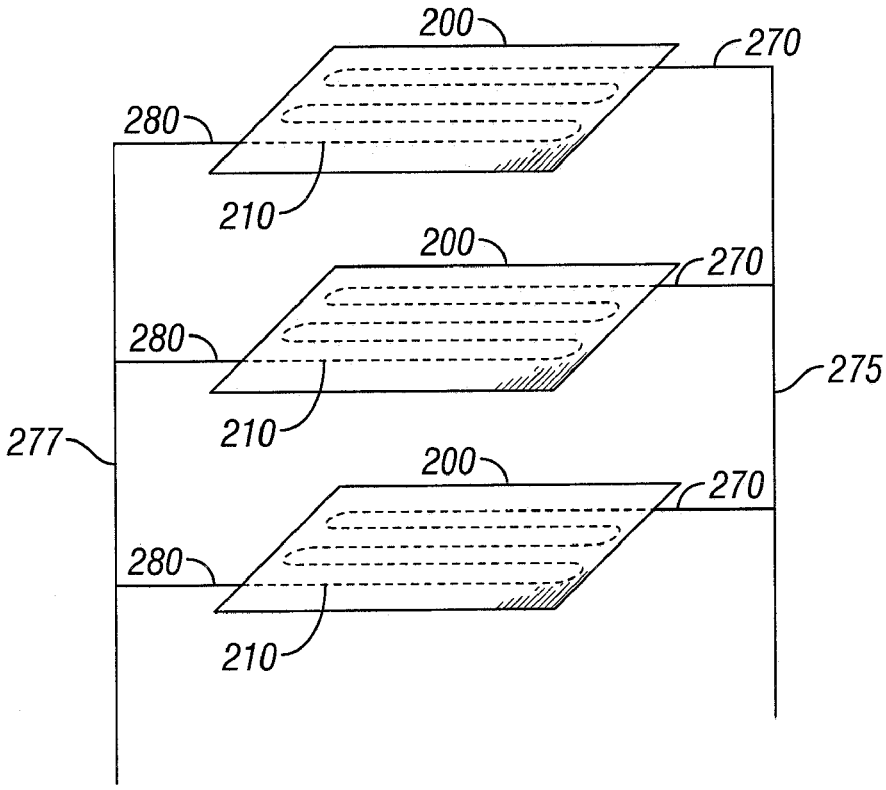
FIG. 2 shows a plurality of sublimation plates and corresponding thermal elements in accordance with one or more embodiments of the present invention.

FIG. 2 shows an embodiment of a sublimator system including three sublimation plates 200. For clarity, in FIG. 2, only the three thermal elements 210 of the sublimation plates 200 are shown. Thermal elements 210 may be connected via their three corresponding inlet ends 270 with a manifold 275. Likewise, outlet ends 280 may be connected to a second manifold 277. Thus, heated coolant is introduced at first manifold 275 and is delivered to the three thermal elements 210, where the heat is distributed to the large pore substrates (not shown) of each sublimation plate 200. As shown in FIG. 2, sublimation plates 200 are arranged in parallel. However, one skilled in the art will appreciate that sublimation plates 200 may be arranged in series, parallel, or combinations thereof. In a similar manner, the feed water may be delivered to the plurality of inlets on the sublimation plates individually or via a manifold as shown.

Figure 3:
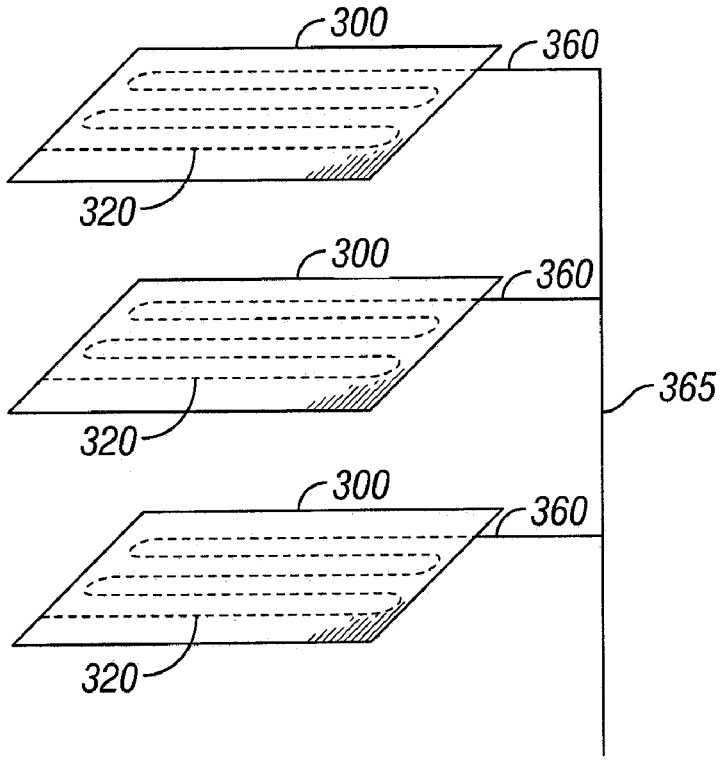
FIG. 3 shows a plurality of sublimation plates and corresponding feed water channels in accordance with one or more embodiments of the present invention.

FIG. 3 shows an embodiment of a sublimator system including three sublimation plates 300. For clarity, in FIG. 3, only feed water channels 320 are shown. Feed water channels 320 may receive feed water via inlet ends 360, which may be connected to manifold 365. Sublimation plates 300 may be attached in parallel and may not include an outlet end for the feed water channel 320. In an alternate embodiment, at least some of the feed water channels 320 may be equipped with an outlet end for attachment in series. The feed water is distributed to the large pore substrate (not shown) where the feed water turns to ice and then sublimes from the system. The rate at which the feed water is delivered to the large pore substrate may be strictly controlled by a control point as shown in FIG. 4.

Figure 4:
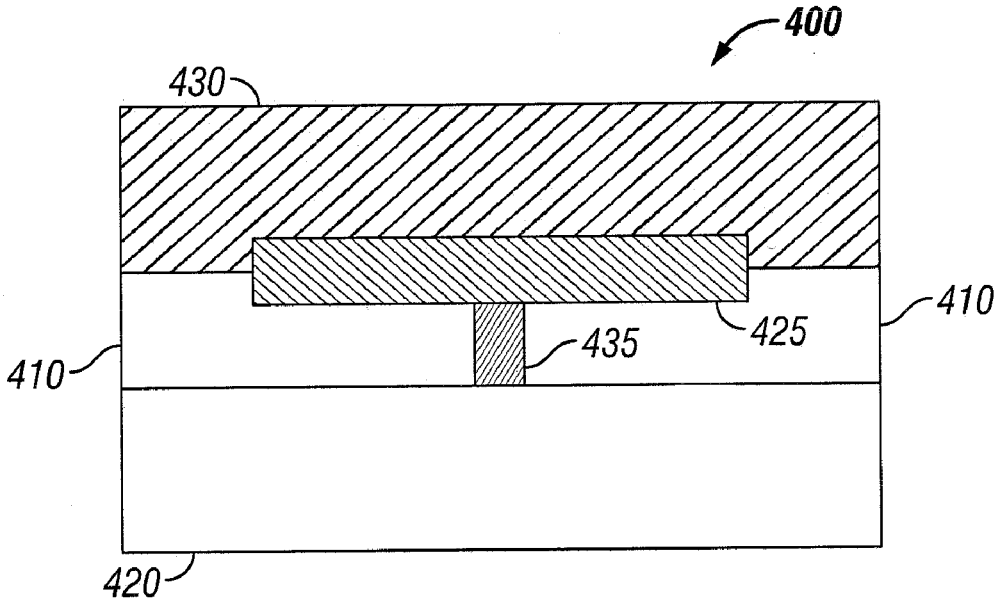
FIG. 4 shows a control point for feed water delivery to a large pore substrate in accordance with one or more embodiments of the present invention.

FIG. 4 shows a partial cross-sectional of a sublimation plate 400, in accordance with one or more embodiments of the present invention. Feed water is delivered from feed water channel 420 via nozzle 435 to control point 425. In one embodiment, control point 425 may be made of any porous material known in the art, for example, sintered metals such as nickel, aluminum, copper, brass, steel, alloys, or combinations thereof. The pore size of control point 425 may vary from about 1 to 10 μm in one embodiment and from about 3 to 6 μm in one or more embodiments. Such small pore sizes may provide the necessary back pressure to exert tight control of the rate of delivery of the feed water to the large pore substrate 430. The feed water pressure may be regulated from about 1 psi to about 15 psi, in one or more embodiments. In one or more embodiments the feed water pressure may be regulated from 3 to 5 psi.

The feed water is delivered via control point 425 to the large pore substrate 430. The pore size of large pore substrate 430 may vary from about 100 to 1000 μm in one or more embodiments and from about 300 to 350 μm in one or more embodiments. The large pore substrate 430 may be a foam having an open-cell morphology and may comprise organic or metal foams as known in the art. For example, organic foams may include polyurethane, polyethylene, polyimide, or polystyrene. Metallic foams may include, for example, at least one selected from aluminum, copper, brass, steel, alloys, and combinations thereof. Additionally, it may be beneficial to have a large pore substrate 430 with resistance to large vibrational loads and high thermal conductivity.

As shown in FIG. 4, the thermal element 410 is disposed between feed water channel 420 and the large pore substrate 430. The heated coolant runs through thermal element 410 transferring heat to large pore substrate 430, which, in turn, assists in the sublimation of ice that collects within the pores of the large pore substrate 430. Thus, the effectiveness of heat transfer may be optimal with large pore substrate 430 having a thermal conductivity of 70 W/mK or greater. The heated coolant may be water in one or more embodiments, although any heat transfer fluid could be used. The heated coolant runs around nozzle 435 in thermal element 410. Additionally, the heated coolant may be separated from the large pore substrate 430, the feed water channel 420 and control point 425 so that the coolant and feed water do not mix. Finally, it should be noted that FIG. 4 depicts a sublimation plate 400 having a large pore substrate on only one side. The various structural components shown in FIG. 4 are mirrored on the opposite side of feed water channel 420 in embodiments having a large pore substrate on each side.

Figure 5:
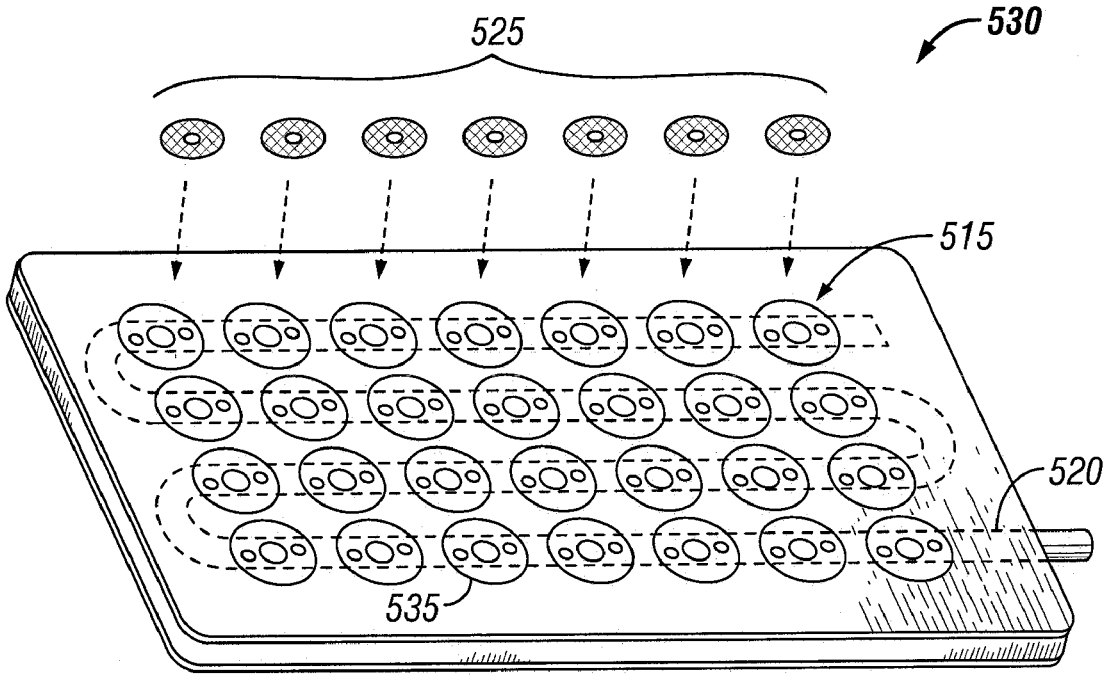
FIG. 5 shows a control point with a plurality of nozzles to deliver feed water to a plurality of sintered metal disks in accordance with one or more embodiments of the present invention.

FIG. 5 shows a control point 515, prior to attachment of a large pore substrate, in accordance with one or more embodiments of the present invention. The control point 515 may be comprised of an array of sintered metal disks 525, for example, which are seated over nozzles 535. The nozzles 535, in turn, are connected to the feed water channel 520. One skilled in the art will appreciate that the sintered metal material and the groove in which it is seated may be constructed in any geometric shape. At least one nozzle 535 per sintered metal disk 525 may distribute feed water from the feed water channel 520. One skilled in the art will appreciate that because the feed water may cool while traversing the feed water channel 520, the amount of feed water delivered to the large pore substrate (not shown) may be increased. Thus, the diameter of nozzles 535 may also increase along the feed water channel 520 and may vary in diameter from about 0.005 to 0.200, in one embodiment, and from about 0.15 to about 0.70 in one embodiment. More specifically, in one embodiment the nozzle diameter varies from approximately 0.016 to 0.063. The diameter of nozzles 535 and the pore size of sintered metal disks 525, synergistically control the rate of delivery of feed water from the feed water channel 520 to the large pore substrate.

Figure 6:
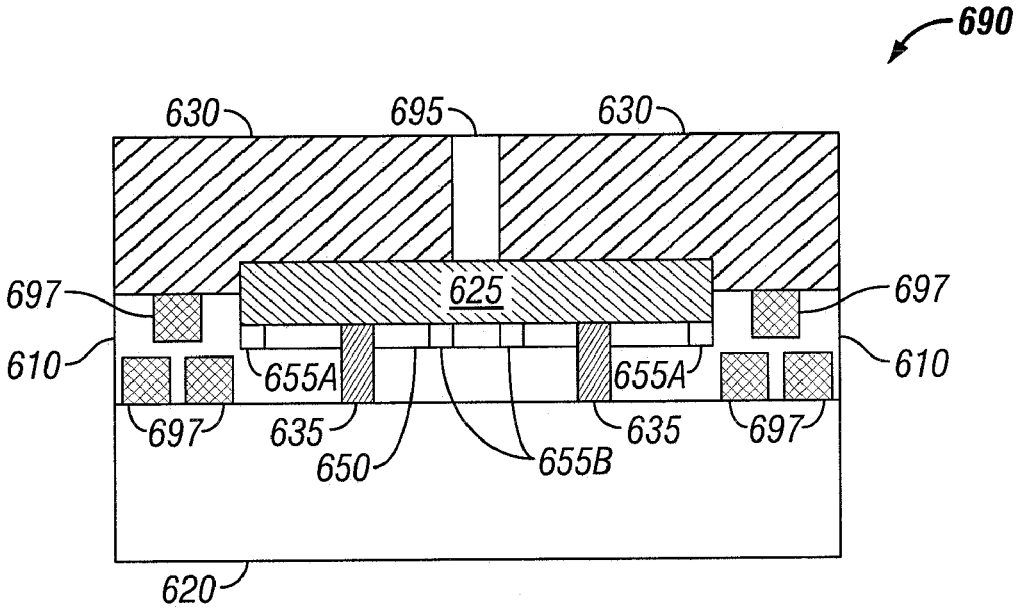
FIG. 6 shows a sublimation plate assembly in accordance with one or more embodiments of the present invention.

In one or more embodiments, feed water may be delivered between feed water channel 620 and sintered metal disk 625 with any number of nozzles 635, for example, two as shown in FIG. 6. The sintered metal disk 625 may be seated in a groove 650, reinforced with O-rings 655*a* and 655*b*. The sublimation plate assembly 690 may be held together by attachment of the large pore substrate 630 to the surface of the feed water channel 620 via an attachment means 695 commonly known in the art, for example, with a bolt, rivet, screw, or the like. Additionally, the interface of the thermal element 610 and the feed water channel 620 may be secured by brazing, welding, or other technique known in the art. To aid in heat transfer to large pore substrate 630, coolant fins 697 may be brazed along the walls of thermal element 610.

In operation, feed water is delivered from the feed water channel, 620 to the sintered metal disks 625 via nozzles 635. Sintered metal disks 625 then distribute the feed water to the large pore substrate 630. The feed water freezes to ice in the large pore substrate 630. Concomitantly, heated coolant is passed through thermal element 610. Heat is transferred, with the aid of coolant fins 697, to the large pore substrate 630, causing the ice to sublime rather than melt because the aluminum surface is subjected to a vacuum (which may be the vacuum of space). One skilled in the art will appreciate that one may control the rate of heat dissipation by controlling the rate of sublimation by control of the feed water pressure and the flow rate and temperature of the heated coolant.

Figure 7:
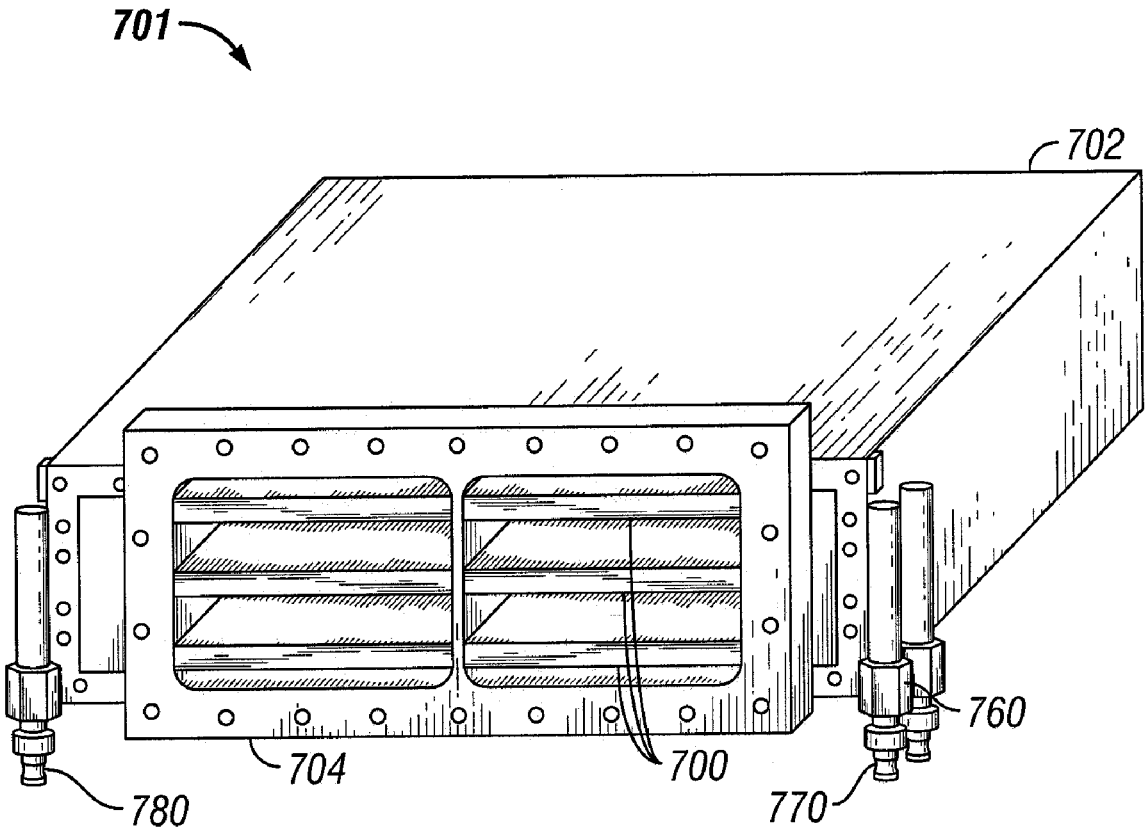
FIG. 7 shows a sublimator in accordance with one or more embodiments of the present invention.

The placement of several sublimation plates in a sublimator apparatus is shown in further detail in FIG. 7. Referring to FIG. 7, in one or more embodiment, a sublimator 701 comprises at least one sublimation plate 700 with thermal element inlet end 770, thermal element outlet end 780, and feed water inlet 760. This assembly may be mounted in a metal box 702 with a single open end flange 704 equipped with an attachment means to a vacuum duct (not shown). The box may be constructed of a lightweight metal, such as aluminum and the sections brazed together to minimize the weight of the sublimator. In one or more embodiments, the vacuum duct may vent to space when used in a space vehicle or in conjunction with a space suit or other garment. In one or more embodiments, the vacuum duct may be attached to a vacuum pump, which may be appropriate for use of a sublimator in other environments.

Although embodiments described herein use feed water as an evaporant in the sublimation process, one skilled in the art will recognize that other evaporants may be used to achieve the same results in nominally the same manner. Such evaporants (refrigerants) may include for example, R134a which is commercially available from Refrigerant Supply, Inc. (Dayton, Ohio).

EXAMPLE

The following data is exemplary of a sublimator constructed in accordance with one embodiment of the present invention. The sublimator of this example has three sublimation plates with water as the coolant. The large pore substrate is a metallic aluminum foam. The sintered metal disks were made of stainless steel. Such a sublimator may reject heat at a rate of about 35,000 BTU/h with a coolant flow rate of 500 lb/hr at 108° F. and a feed water pressure of 3 psi.

Advantageously, embodiments of the present invention may provide a contaminant insensitive sublimator due to the large pore size where the ice resides prior to sublimation. Thus, collected impurities in the large pore substrate may not alter the sublimation properties. This relaxes the tight restrictions on feed water quality, which also may reduce costs. Additionally, the control point made with sintered metal material provides a flow rate control that is constant over time due to the structural integrity of sintered metal material. The use of water may be favorable as an evaporant because of its high latent heat of vaporization, making it well-suited for rejecting large amounts of heat per mass of water.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A sublimator comprising:
a sublimation plate comprising:
a thermal element disposed adjacent to a feed water channel; and
a control point disposed between at least a portion of the thermal element and a large pore substrate;
wherein the control point comprises a sintered metal material.

2. The sublimator of claim 1, wherein a plurality of nozzles deliver the feed water from the feed water channel to the control point.

3. The sublimator of claim 2, wherein the plurality of nozzles vary in diameter from 0.015 to 0.70.

4. The sublimator of claim 1, wherein the sintered metal material has a pore size ranging from 1 to 10 μm.

5. The sublimator of claim 4, wherein the sintered metal material has a pore size ranging from 3 to 6 μm.

6. The sublimator of claim 1, wherein the sintered metal material is at least one selected from nickel, aluminum, copper, brass, steel, alloys, and combinations thereof.

7. The sublimator of claim 1, further comprising a plurality of sublimation plates.

8. The sublimator of claim 7, wherein a first manifold is attached to an inlet end of the thermal element of each of the plurality of sublimation plates.

9. The sublimator of claim 7, wherein a second manifold is attached to an outlet end of the thermal element of each of the plurality of sublimation plates.

10. The sublimator of claim 7, wherein a feed water manifold is attached to an inlet end of the feed water channel of each of the plurality of sublimation plates.

11. The sublimater of claim 1, wherein the large pore substrate has a pore size ranging from 100 to 1000 μm.

12. The sublimator of claim 11, wherein the large pore substrate has a pore size ranging from 300-350 μm.

13. The sublimator of claim 1, wherein the large pore substrate comprises an open-cell foam selected from at least one of an organic polymer and a metal foam.

14. The sublimator of claim 13, wherein the open-cell foam has a thermal conductivity of at least 70 W/mK or greater.

15. The sublimator of claim 13, wherein the open-cell foam comprises a metal foam selected from at least one of aluminum, copper, brass, steel, alloys, and combinations thereof.

16. A sublimator comprising:
a sublimation plate comprising:
a thermal element disposed adjacent to a feed water channel; and
a control point disposed between at least a portion of the thermal element and a large pore substrate, wherein the control point restricts a flow rate of feed water from the feed water channel to the large pore substrate independent of time.

17. The sublimator of claim 16, wherein a plurality of nozzles deliver the feed water from the feed water channel to the control point.

18. The sublimator of claim 16, further comprising a plurality of sublimation plates.

19. The sublimator of claim 16, wherein the large pore substrate is an open-cell foam selected from at least one of an organic polymer and a metal foam.

* * * * *